US007946609B2

(12) United States Patent
Johnson et al.

(10) Patent No.: US 7,946,609 B2
(45) Date of Patent: May 24, 2011

(54) WHEELED TRANSPORTING DEVICE WITH TELESCOPING LEG STABILIZATION

(76) Inventors: Kenneth R. Johnson, Dallas, TX (US); Melissa A. Johnson, Dallas, TX (US)

( * ) Notice: Subject to any disclaimer, the term of this patent is extended or adjusted under 35 U.S.C. 154(b) by 743 days.

(21) Appl. No.: 11/701,565

(22) Filed: Feb. 2, 2007

(65) Prior Publication Data

US 2007/0296317 A1 Dec. 27, 2007

(51) Int. Cl.
*B62B 1/04* (2006.01)

(52) U.S. Cl. ..... 280/652; 280/47.27; 280/655; 280/47.19; 280/47.2; 280/63

(58) Field of Classification Search ..... 280/47.19, 280/47.29, 47.26, 47.27, 47.24, 47.25, 30, 280/638, 652, 47.2, 63; 190/8, 11, 18 A; 312/282; 108/42, 48

See application file for complete search history.

(56) References Cited

U.S. PATENT DOCUMENTS

| | | | | |
|---|---|---|---|---|
| D142,262 | S | | 8/1945 | Paden |
| 2,604,959 | A | | 7/1952 | Arbib |
| 2,784,004 | A | | 3/1957 | Hamrick |
| 3,557,916 | A | * | 1/1971 | Stowell ..... 190/11 |
| 4,290,625 | A | | 9/1981 | Barriere et al. |
| 4,538,709 | A | | 9/1985 | Williams et al. |
| 4,595,086 | A | | 6/1986 | Simpson |
| 4,618,035 | A | | 10/1986 | Mao |
| 4,886,233 | A | | 12/1989 | Bateman et al. |
| 5,161,811 | A | | 11/1992 | Cheng |
| 5,306,027 | A | | 4/1994 | Cheng |
| 5,337,682 | A | | 8/1994 | Wiseman |
| 5,374,073 | A | | 12/1994 | Hung-Hsin |
| 5,437,367 | A | | 8/1995 | Martin |
| 5,469,944 | A | * | 11/1995 | Wang ..... 190/18 R |
| 5,505,471 | A | | 4/1996 | Cheng |
| 5,507,508 | A | | 4/1996 | Liang |
| 5,529,322 | A | | 6/1996 | Barton |
| 5,547,205 | A | | 8/1996 | do Rosario Sousa de Cabedo |
| 5,695,246 | A | | 12/1997 | Tsai et al. |
| D403,871 | S | | 1/1999 | Terry, Jr. |
| 5,863,055 | A | | 1/1999 | Kasravi et al. |
| 5,941,352 | A | | 8/1999 | Lee |
| 5,961,134 | A | * | 10/1999 | Congleton et al. ..... 280/47.18 |
| 6,053,587 | A | | 4/2000 | Boerder |
| 6,079,678 | A | | 6/2000 | Schott et al. |

(Continued)

FOREIGN PATENT DOCUMENTS

DE 4323751 2/1994

(Continued)

OTHER PUBLICATIONS

Copenheaver, Blaine R., International Search Report for the International Application PCT/US2008/052841 as mailed Jul. 2, 2008 (3 pages).

*Primary Examiner* — J. Allen Shriver, II
*Assistant Examiner* — Bridget Avery
(74) *Attorney, Agent, or Firm* — Winstead PC

(57) ABSTRACT

A compactable wheeled transport system with a first pivotal shelf for ease of transporting a first object in a first mode of operation. A compactable wheeled transport system with a second pivotal shelf for use as a work surface and support a second object thereon. Additionally, a pivotal foot is disclosed for stabilization of the system.

16 Claims, 8 Drawing Sheets

U.S. PATENT DOCUMENTS

| | | | | |
|---|---|---|---|---|
| 6,105,508 | A * | 8/2000 | Ryburg | 108/42 |
| 6,196,560 | B1 | 3/2001 | Ohlsson | |
| 6,267,393 | B1 * | 7/2001 | Mengrone et al. | 280/37 |
| D459,883 | S | 7/2002 | Worrell et al. | |
| 6,439,134 | B1 | 8/2002 | Ryburg | |
| 6,543,796 | B1 | 4/2003 | Johnson et al. | |
| 6,595,334 | B1 | 7/2003 | Saetia | |
| 6,604,720 | B1 * | 8/2003 | Wilson | 248/177.1 |
| 6,644,447 | B2 * | 11/2003 | Pohl | 190/8 |
| 6,688,634 | B2 * | 2/2004 | Noffsinger | 280/651 |
| 6,736,073 | B2 | 5/2004 | Ryburg | |
| 6,932,427 | B2 | 8/2005 | Tamura et al. | |
| 7,040,635 | B1 | 5/2006 | Remole | |
| 7,278,644 | B2 * | 10/2007 | Villarreal | 280/47.26 |
| 7,331,596 | B2 | 2/2008 | Tiramani et al. | |
| 7,445,216 | B1 * | 11/2008 | Chou | 280/47.26 |
| 2005/0099104 | A1 | 5/2005 | Johnson et al. | |
| 2005/0133326 | A1 | 6/2005 | Hoberman et al. | |
| 2008/0012255 | A1 | 1/2008 | Johnson | |

FOREIGN PATENT DOCUMENTS

| | | |
|---|---|---|
| WO | WO-2005/043321 | 5/2005 |

* cited by examiner

WHEELED TRANSPORTING DEVICE WITH TELESCOPING LEG STABILIZATION

CROSS REFERENCE TO RELATED APPLICATIONS

This patent application incorporates by reference the entire disclosure of U.S. patent application Ser. No. 10/986,239, filed on Nov. 11, 2004. This patent application also incorporates by reference the entire disclosure of U.S. Provisional Patent Application Nos. 60/626,703, 60/600,743, and 60/519,169.

BACKGROUND OF THE INVENTION

1. Field of the Invention

This invention pertains to wheeled transport systems, and more particularly, but not by way of limitation, to a wheeled transport system incorporating at least one pivotally mounted, telescoping leg and transversely angulated foot assembly in conjunction with a pivotal work surface for the stabilization thereof.

2. History of the Related Art

Lap top computers and similar devices have been developed to enable business travelers to perform other work tasks while traveling. Despite their convenience, they are not truly comfortable to use on one's lap. In an airplane, this discomfort may be alleviated by the use of the folding tray tables with which aircraft seats are equipped. But in airport waiting rooms and hotel lobbies, where travelers necessarily spend a significant amount of time, there are no suitable work surfaces where lap top computers may be placed and used.

U.S. Pat. No. 6,543,796B1, incorporated herein by reference, provides a substantial improvement over previous designs. A luggage carrier, as described therein, includes a work surface pivotally extendable from a frame. The work surface is supported at one end by the frame and at the opposite end by one or more telescopic legs.

U.S. Provisional Patent Application Ser. No. 60/519,169 entitled "Wheeled Transporting Device," herein incorporated by reference, provides yet additional improvements over previous designs. A luggage carrier, as described therein, includes a work surface pivotally extendible from a frame, with the frame stabilized by an extendible leg.

BRIEF SUMMARY OF THE INVENTION

The present invention relates to wheeled transporting devices. More particularly, one embodiment includes a combined desk and article carrier assembly adapted for multiple modes of operation. One embodiment includes three modes, comprising a first collapsed mode for both storage and mobility, a second, semi-collapsed mode for transporting at least one article and for serving as a work desk in an expanded third mode. The assembly comprises a frame having upper and lower ends, the lower end having wheels and the upper end of the frame, including a handle upwardly telescopic relative thereto for facilitating the mobility of the frame on the wheels thereof. An article support shelf is pivotally connected to a first side of the frame near the lower end thereof and adapted to pivot outwardly and downwardly away from the frame to a generally horizontal position for supporting at least one article placed thereon in the second mode. A desk-top shelf is pivotally connected to a second, opposite side of the frame near a top end thereof and adapted to pivot outwardly and upwardly to a generally horizontal position to form a work desk in the third mode. Finally, a deployable foot support is pivotally connected to, and adapted for transverse, angular deployment outwardly from the second side of the frame near a bottom end thereof in the third mode of operation.

In another embodiment of the present invention, there are four modes of operation. In one mode, the assembly is collapsed and in a second, it may be loaded with bags for rolling transport. In a third mode, the handle extends upwardly from the desk-top shelf during use, while in a fourth mode, the handle is collapsed to be flush with the desk top shelf. In one design embodiment, the deployable foot is angularly connected to a mounting brace in a corner region of the frame. The deployable foot comprises in this embodiment, an elongate bar that pivots transversely outwardly and locks in position for providing stability to the assembly in the expanded, third and fourth modes, described herein.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE INVENTION

Figure 1:
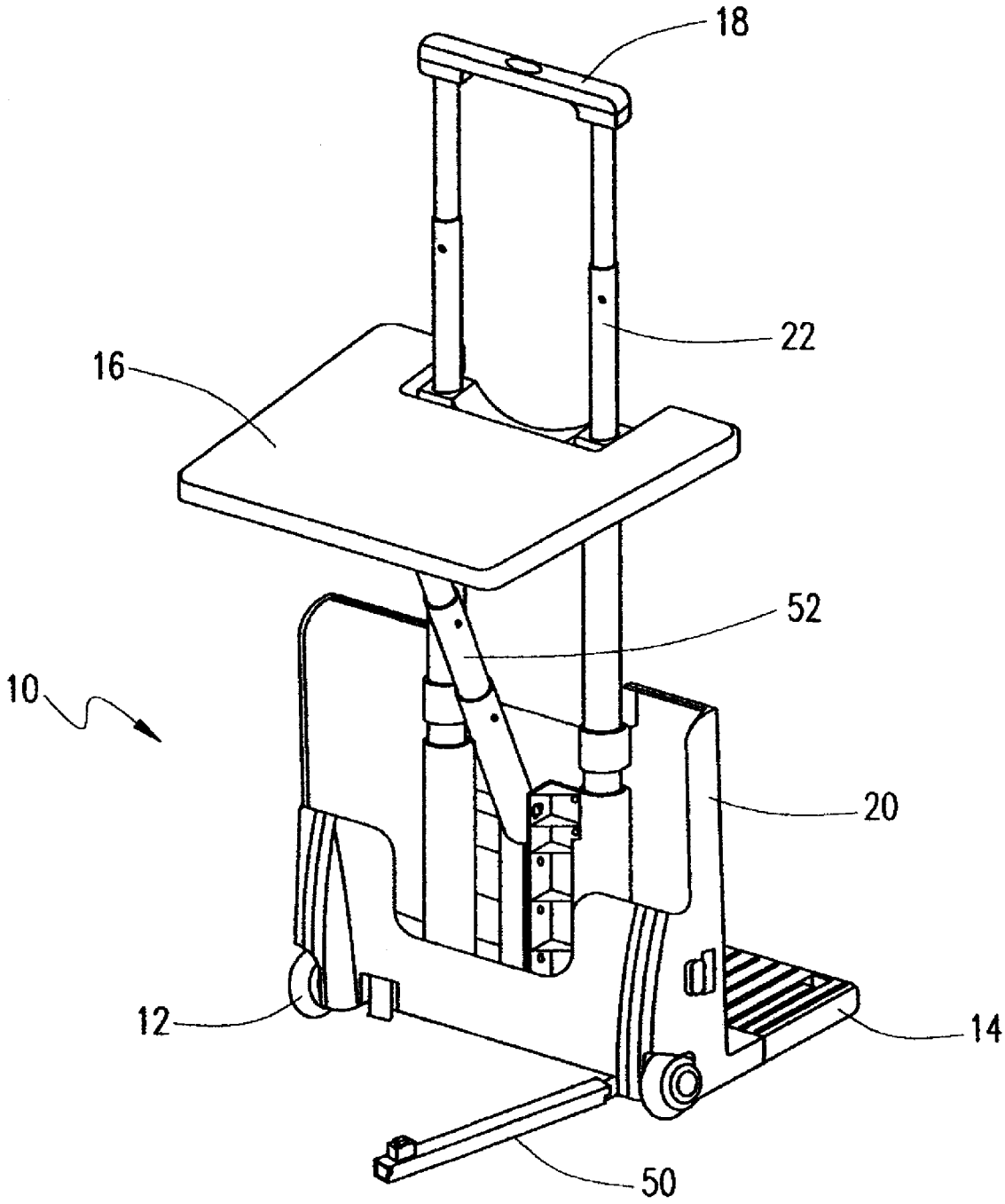
FIG. 1 is a perspective view of one embodiment of the present invention with a tray extended into a working configuration for supporting a laptop computer or the like thereupon.

FIG. 1 shows a carrier 10 in accordance with certain embodiments of the present invention. The carrier 10 includes a set of wheels 12 for ease of transportation. One embodiment may also include a lower support shelf 14 for receiving luggage or the like. The carrier 10 includes a work surface 16 and a handle 18 that may be extended for purposes of control and transport. The handle 18 may extend via a pair of telescoping arms 22 that connect to a chassis 20. As will be described in more detail below, the handle 18 may be extended to aid in the transportation of the carrier 10 and any luggage or other articles that may be placed on the lower support shelf 14. The handle 18 may also be retracted to a lower position when the work surface 16 is orthogonally extended or when the carrier 10 is in a compact storage mode. In the embodiment shown, the work surface 16 has been pivoted outwardly to an orthogonal position relative to the telescoping arms 22 for use as a tray. In this mode, a computer or the like may be placed thereupon. The work surface 16 may be structurally stabilized and supported by virtue of a telescoping support arm 52. It can also be seen that the work surface 16, when orthogonally disposed, is in an elevated position in conjunction with the pivotally mounted, outwardly angularly oriented stabilization foot 50 wherein stabilization is afforded to the carrier 10. Stabilization foot 50 is provided to further stabilize the carrier 10 and to prevent the assembly from tipping if too heavy of a load is placed on work surface 16. The deployable stabilization foot 50 can be swung out and locked in place at an angle sufficient to stabilize the carrier 10 as will be discussed in more detail below.

Figure 2:
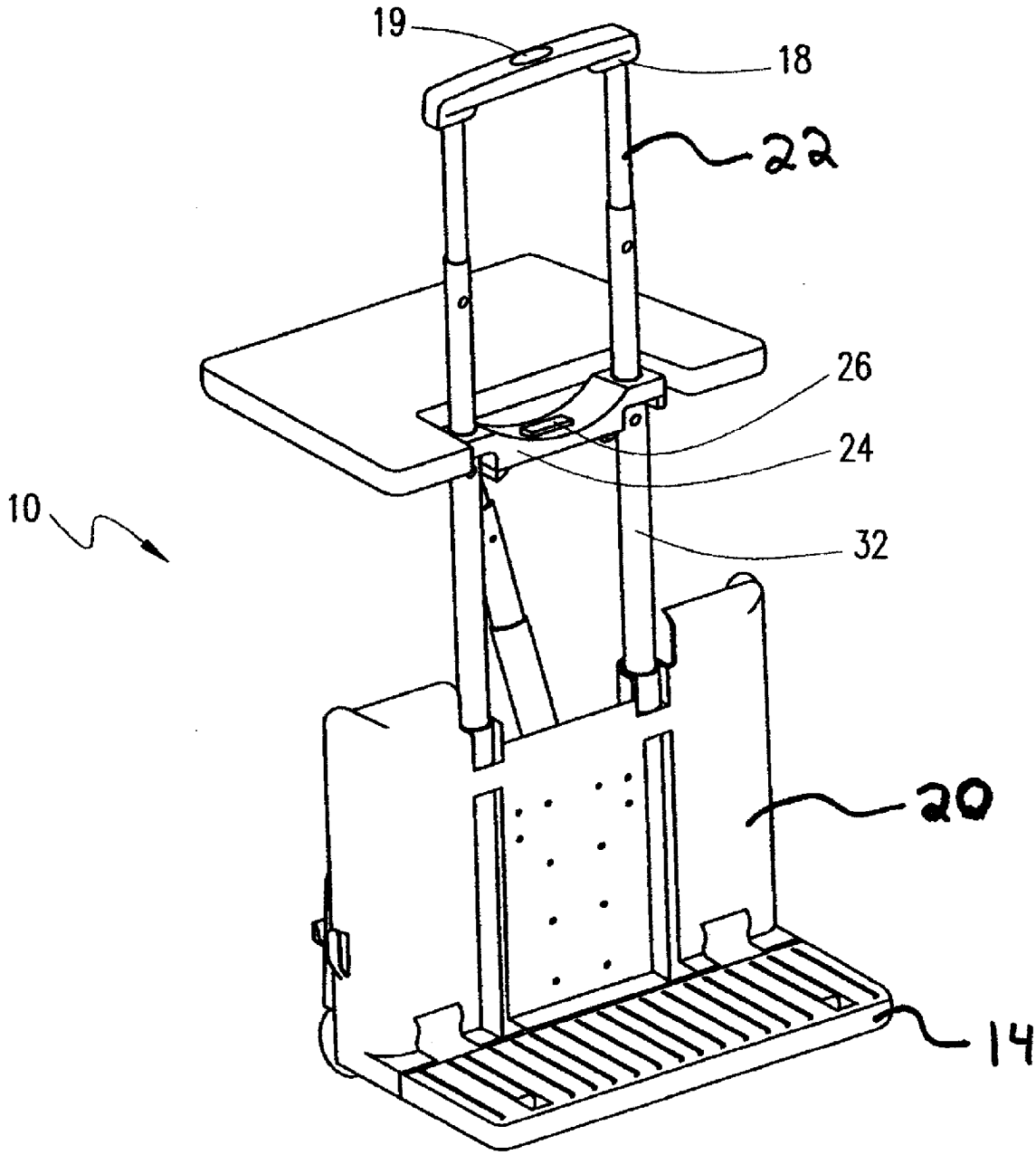
FIG. 2 is a perspective view of one embodiment of the present invention with a tray extended into a working configuration for supporting a laptop computer or the like thereupon.

Referring now to FIG. 2, there is a perspective view of the carrier 10 shown in a mode of operation wherein the handle 18 is fully extended upwardly, while the work surface 16 is in a position for the placement of an object, such as a laptop computer, thereon. The lower support shelf 14 is in an orthogonal position relative to the chassis 20. A strap (shown in FIG. 5) can be used to secure luggage or the like thereupon. As will be explained further below, in one embodiment, a handle release button 19 may need to be depressed before the handle 18 may be raised. In this particular view, work surface 16 is pivotally attached to a slide 24 which has been upwardly extended out of chassis 20 along telescoping arms 22 for positioning therealong and generally orthogonal extension out therefrom for the placement of the laptop computer or the like thereon for providing a work surface. In one embodiment, a release button 26 may need to be depressed before the slide 24 may be lifted causing the telescoping arms 22 to extend. In one embodiment, slide 24 locks into place and may be lowered after release button 26 is depressed.

Still referring to FIG. 2, it can be seen that the handle 18 has been fully extended upwardly from the carrier 10. The telescoping characteristic of the telescoping arms 22 can also be seen from this view. When fully extended, the telescoping arms 22 may be locked into the fully extended position so that they will not unintentionally retract. In one embodiment, a handle release button 19 may need to be depressed before the handle 18 can be lowered and the telescoping arms 22 retracted.

In this particular configuration, the carrier 10 has been prepared for use as a work surface for support of an object, such as a laptop computer thereon. It can also be seen that in this embodiment a bag or the like may be placed upon the lower support shelf. The telescoping arms 22 pass through tube guides located on distal ends of the slide 24. As shown, each section of the telescoping arms 22 are fully extended one from another and also fully extended from the chassis 20. When fully extended from the chassis 20, slide 24 may be raised, and the telescoping arms may be locked into place. In one embodiment, a release button 26 must be pressed to allow the slide 24 to be lowered down along the telescoping arms 22. The slide 24 may be raised until flush with the bottoms of ring stoppers (not shown), at which point, the slide 24 locks into place. In the embodiment shown, the ring stoppers are placed at the top of a first telescoping section of the telescoping arms 22, but the ring stoppers may be placed at any predetermined height. The ring stoppers prohibit the slide 24 from being raised to a height above a desired height. In one embodiment, the telescoping arms 22 have holes located below the ring stoppers for the slide 24 to lock into. In other embodiments, other locking mechanisms are contemplated for securing the slide 24 into place along the first section 32 of the telescoping arms 22. As will be described below, when the lower support shelf is in a lowered position, a locking mechanism locks the lower support shelf into place. A release button can then be depressed in order to raise lower support shelf back against chassis 20. Locking lower support shelf into place helps to provide support to carrier 10 and helps prevent carrier 10 from tipping over.

Figure 3:
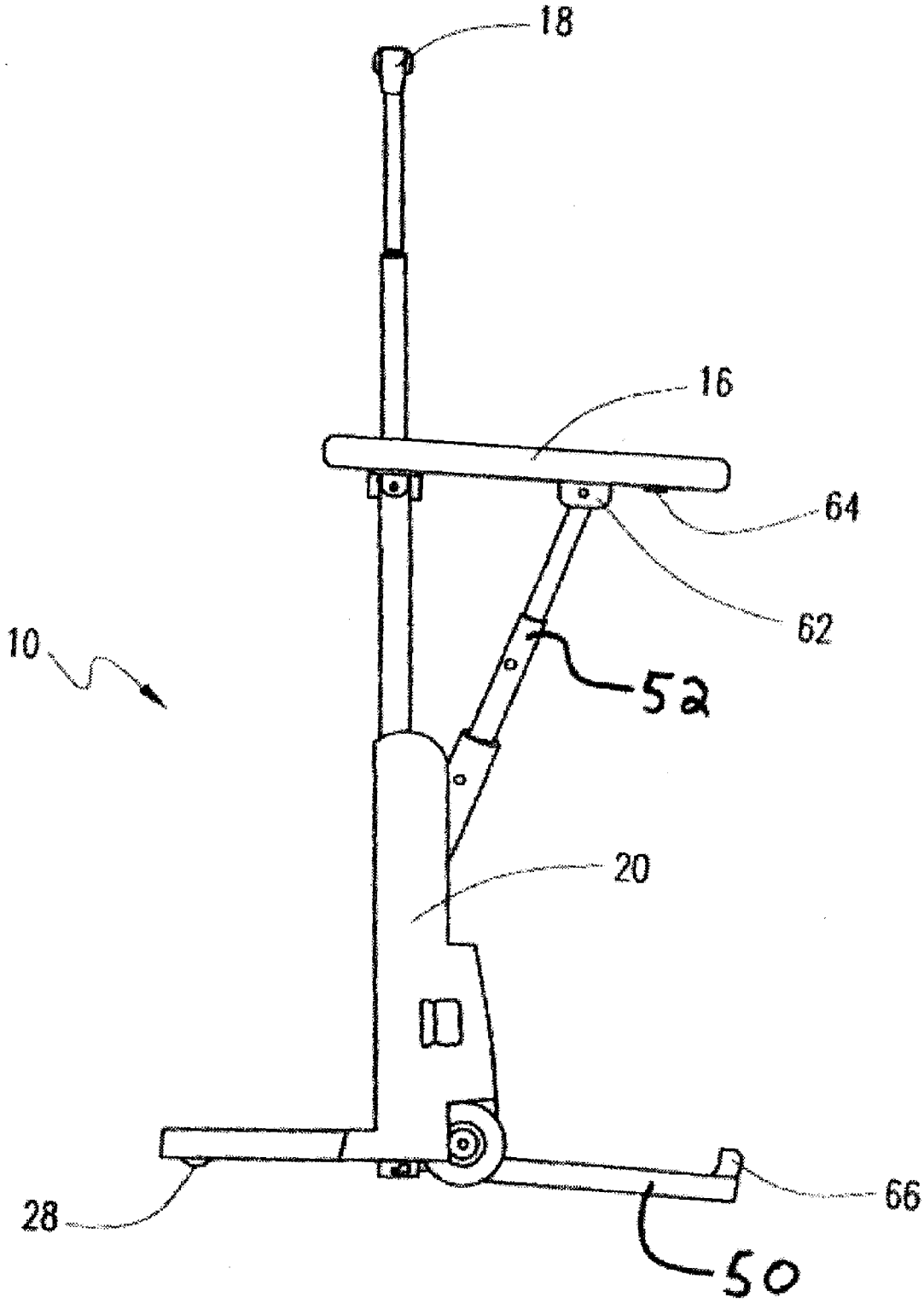
FIG. 3 is a side view of the embodiment of FIG. 1 showing a handle fully extended, the work surface orthogonally extended, and the lower shelf and support foot extended.

Referring now to FIG. 3, there is shown a side view of the fully extended carrier 10 of FIG. 2. It may be seen that an article of luggage secured thereupon can remain on lower support shelf during use of work surface 16. The stability of the carrier 10 is enhanced by the supports 28 on the bottom of lower shelf 14. Supports 28 help additionally stabilize carrier 10 when lower support shelf is in the orthogonal position. In one embodiment, lower support shelf 14 locks into place when in the orthogonal position. Additional stabilization is provided by the stabilization foot 50. When the stabilization foot 50 is fully extended outwardly from chassis 20, the moment forces caused by weight being placed on the work surface 16 are countered by the stabilization foot 50. In the embodiment shown, the stabilization foot 50 is not exactly orthogonal to the chassis 20 when in the fully opened position. As will be explained in more detail below, the stabilization foot 50 rotates on an axis that is angled away from the chassis 20. The tilted axis allows the foot assembly to be off the ground when in a closed position, while still contacting the ground when in a fully opened position. Latching member 66 can be seen from this view extending from a distal end of stabilization foot 50. Latching member 66 secures stabilization foot 50 against the chassis 20 when in a fully closed position. It can also be seen that the telescoping support arm 52 angularly connects the work surface 16 and the chassis 20. Once the work surface 16 has been orthogonally pivoted so that it is substantially perpendicular to both the telescoping arms 22 and the chassis 20, the telescoping support arm 52 locks into place. From this view it can be seen that the telescoping support arm 52 is attached to the bottom of the work surface 16 via bracket 62. The bracket 62 slides within a slot in the bottom of the work surface 16 to allow the carrier 10 to be more compactable when in the storage mode. A release button 64 must be depressed in order for the bracket 62 to be slid back towards the telescoping arms 22, allowing the work surface 16 to be swung down.

Figure 4:
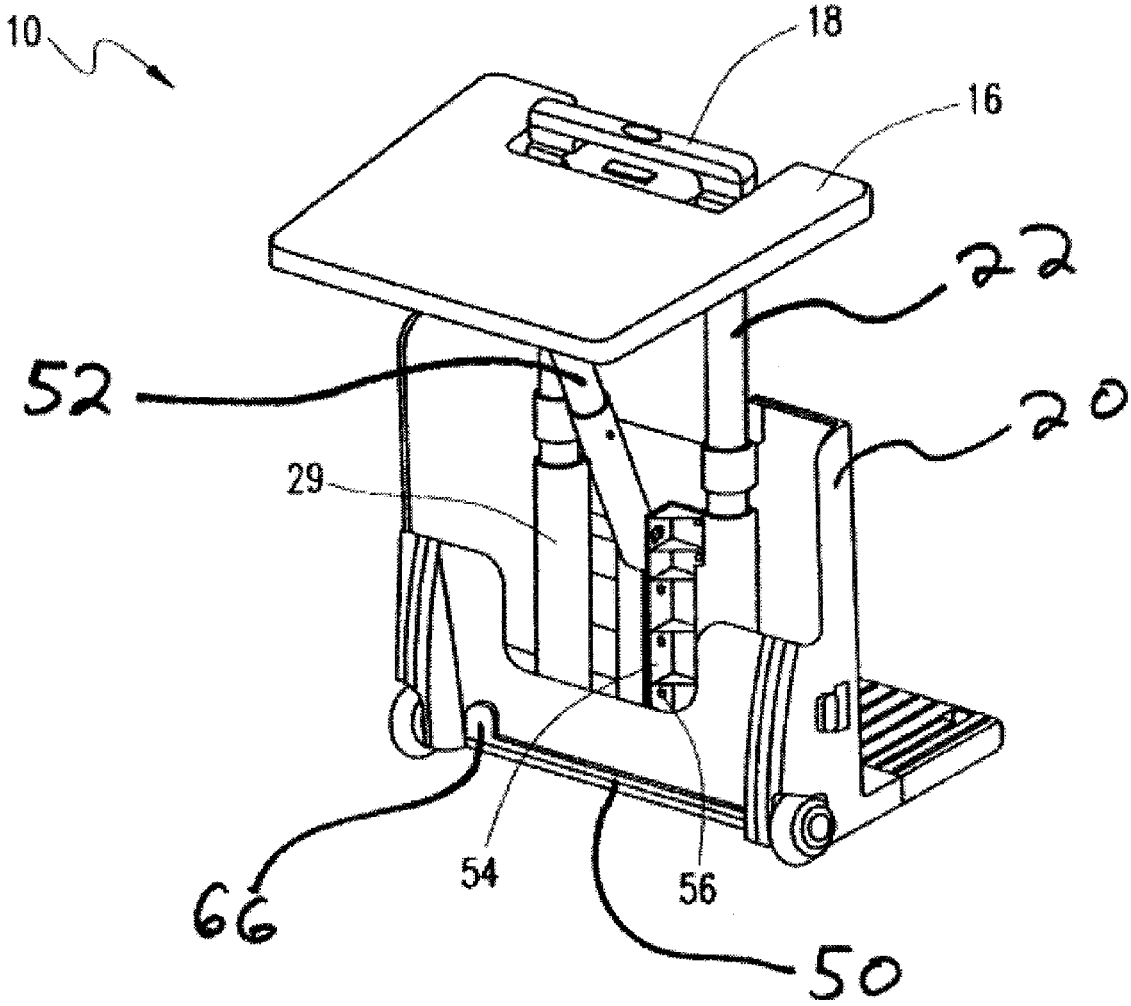
FIG. 4 is a perspective view of the embodiment of FIG. 1 with the work surface orthogonal to a chassis and the handle being in a recessed position.

Referring now to FIG. 4, it can be seen that the stabilizing foot of FIG. 1 is in a closed position, running alongside a bottom edge of the chassis 20. When in this position, the stabilizing foot can be secured against the chassis 20 with the latching member 66. In this view, it can be seen that the support arm transfers part of the load from work surface 16 to support brackets 54. When work surface 16 is rotated outwardly to be substantially perpendicular to telescoping arms 22, telescoping support arm 52 angles outwardly so that it is no longer parallel to the telescoping arms 22. The telescoping support arm 52 pivots around the top of support brackets 54 to help support the weight of a load being placed on work surface 16. Support brackets 54 are connected to chassis 20 with a plurality of screws 56 in order to distribute the weight of a load placed on work surface 16. Additionally, telescoping arms 22 are stabilized by sheaths 29. When work surface 16 is swung out to a position perpendicular to telescoping arms 22, there are three points supporting work surface 16: two telescoping arms 22 held in place by sheaths 29 and angled telescoping support arm 52 supported by brackets 54. This configuration allows an object to be placed on the top of work surface 16 without the interference of handle 18 or telescoping arms 22.

Figure 5:
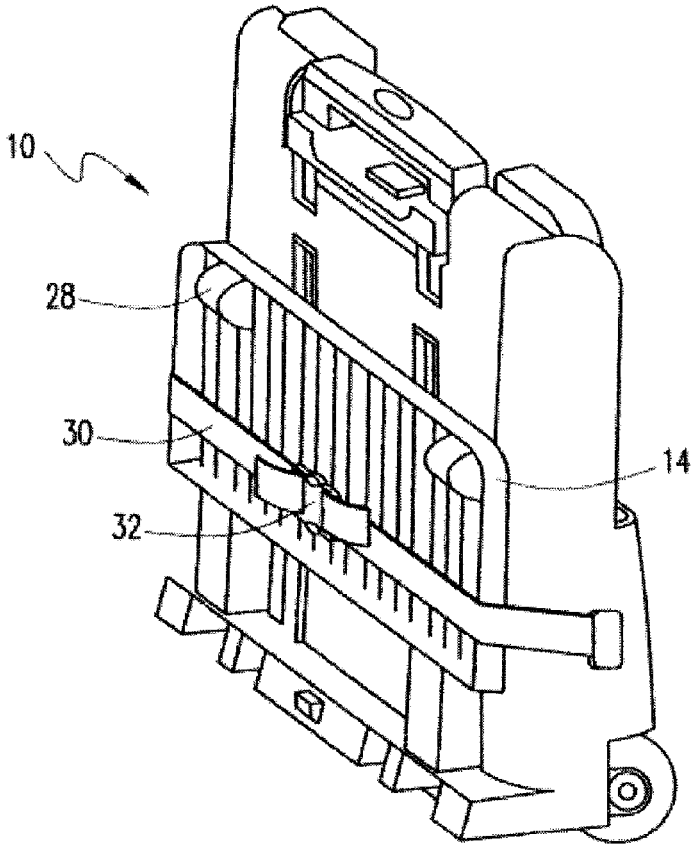
FIG. 5 is a perspective view of the embodiment of FIG. 1 in a collapsed mode where the handle and work surface are in a recessed position.
Figure 6:
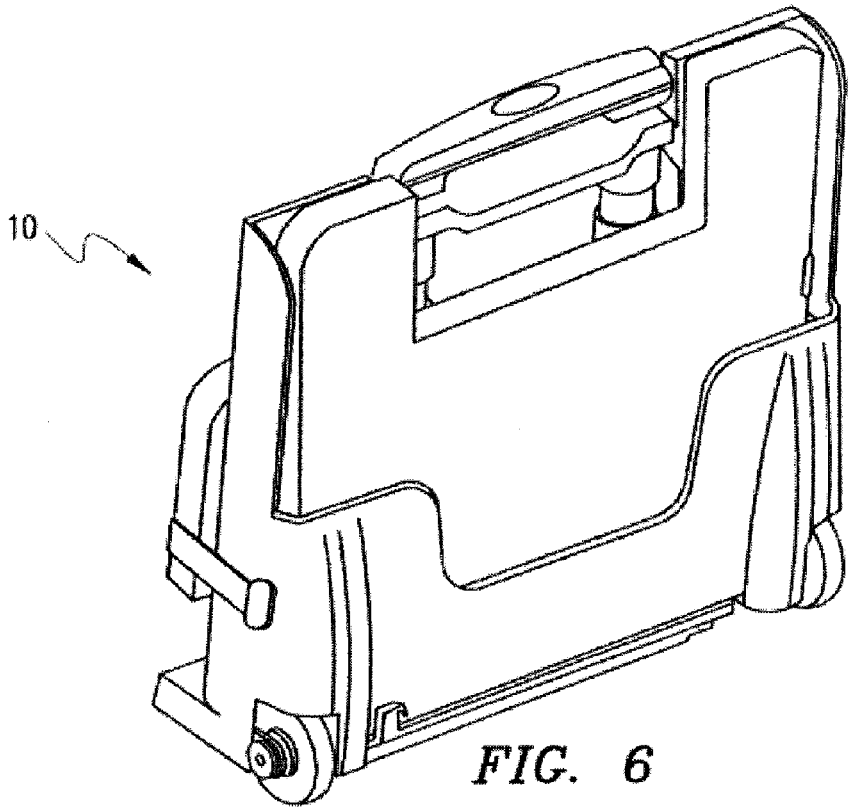
FIG. 6 is a perspective view of FIG. 5 from a different side.

Referring now to FIGS. 5 and 6, the carrier 10 is shown in a mode of operation wherein the carrier 10 is in a fully collapsed storage configuration. In this collapsed state, the carrier 10 may be stored with minimal intrusion relative to other items and is particularly adapted for being placed in either an overhead storage area or under a seat in a conventional commercial aircraft. It may be seen that the handle 18 is fully collapsed relative to the top portion of the chassis 20 of the carrier 10 such that the handle 18 does not extend outwardly therefrom any appreciable distance. It is further seen that a strap or belt 30 is provided for extending around the side of the carrier 10 and securing the lower support shelf as will be discussed further below.

Referring now to FIG. 5 in particular, there is shown a perspective view of the carrier 10 wherein the strap 30 may be seen. In this particular embodiment, the strap 30 is shown securing the lower support shelf 14 of the carrier 10 against the chassis 20 in a collapsed position to further facilitate storage. Other ways of securing the lower support shelf against the chassis 20 are also contemplated such as, for example, a latch or a snap. Other ways of fastening are contemplated such as, for example, hook and loop fasteners. In an expanded condition as shown in FIG. 1, the lower support shelf may become a surface upon which luggage or the like may be placed and any luggage can be secured thereto by the strap 30. In FIG. 6, it can be seen that the work surface 16 fits within the chassis 20 in this collapsed mode of operation.

Figure 7:
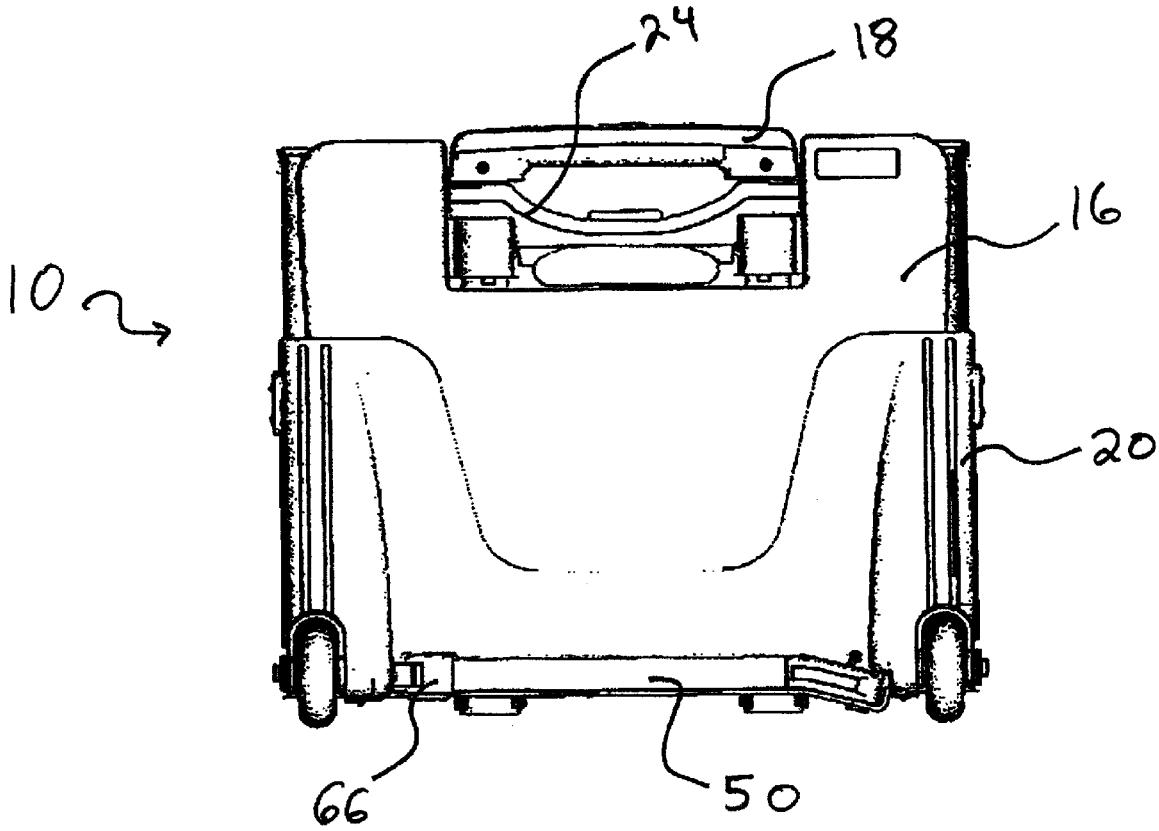
FIG. 7 is a frontal view of one embodiment of FIG. 5 showing the deployable foot in a closed position.

Referring now to FIG. 7, there is shown a frontal view of the carrier 10 of FIGS. 5 and 6 further illustrating various aspects thereof. From this view the stabilization foot 50 beneath the chassis 20 can be seen. When in an extended position, as in FIG. 1, the cantilever loading of an object placed on work surface 16 is transferred through the telescoping struts and the support arm to a mounting base that allows the support thereof. A latching member 66 on the end of stabilization foot 50 can also be seen. While stabilization foot 50 is not in use, it is secured against chassis 20 by latching member 66. Latching member 66 must be depressed in order for stabilization foot 50 to be swung out away from chassis 20. It can also be seen that handle 18 has been pushed back down so that the top of handle 18 is at substantially the same level as the top of the chassis 20.

The figure shows carrier 10 in a first mode of operation where work surface 16 is stowed within chassis 20. Alternatively, work surface 16 may be stowed outside of chassis 20, or in another manner that allows carrier 10 to be more compact when work surface 16 is not in use. In the mode shown, handle 18 is disposed relatively close to chassis 20 and slide 24 is disposed therebetween. Stabilization foot 50 is in a stowed position wherein stabilization foot 50 runs along a bottom edge of chassis 20. Stabilization foot 50 attaches to chassis 20 at an attachment point.

Figure 8:
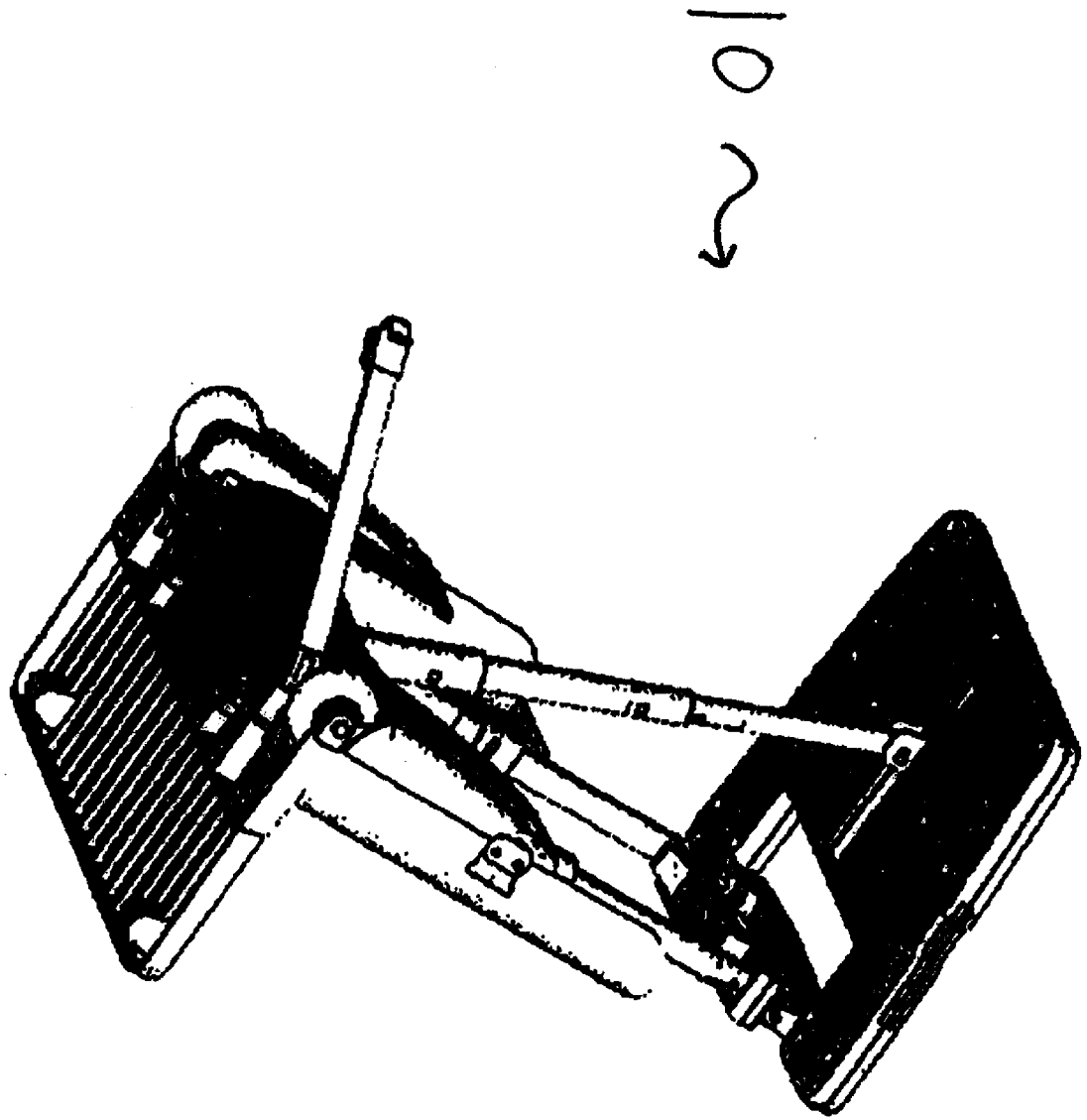
FIG. 8 is a perspective view of an underside of the embodiment of FIG. 1.

Referring now to FIG. 8 an underneath view of the carrier 10 can be seen. From this view, the bracket connecting the support arm to the desktop can be seen. The slot the bracket slides in when the desktop surface is lowered can also be seen.

Figure 9:
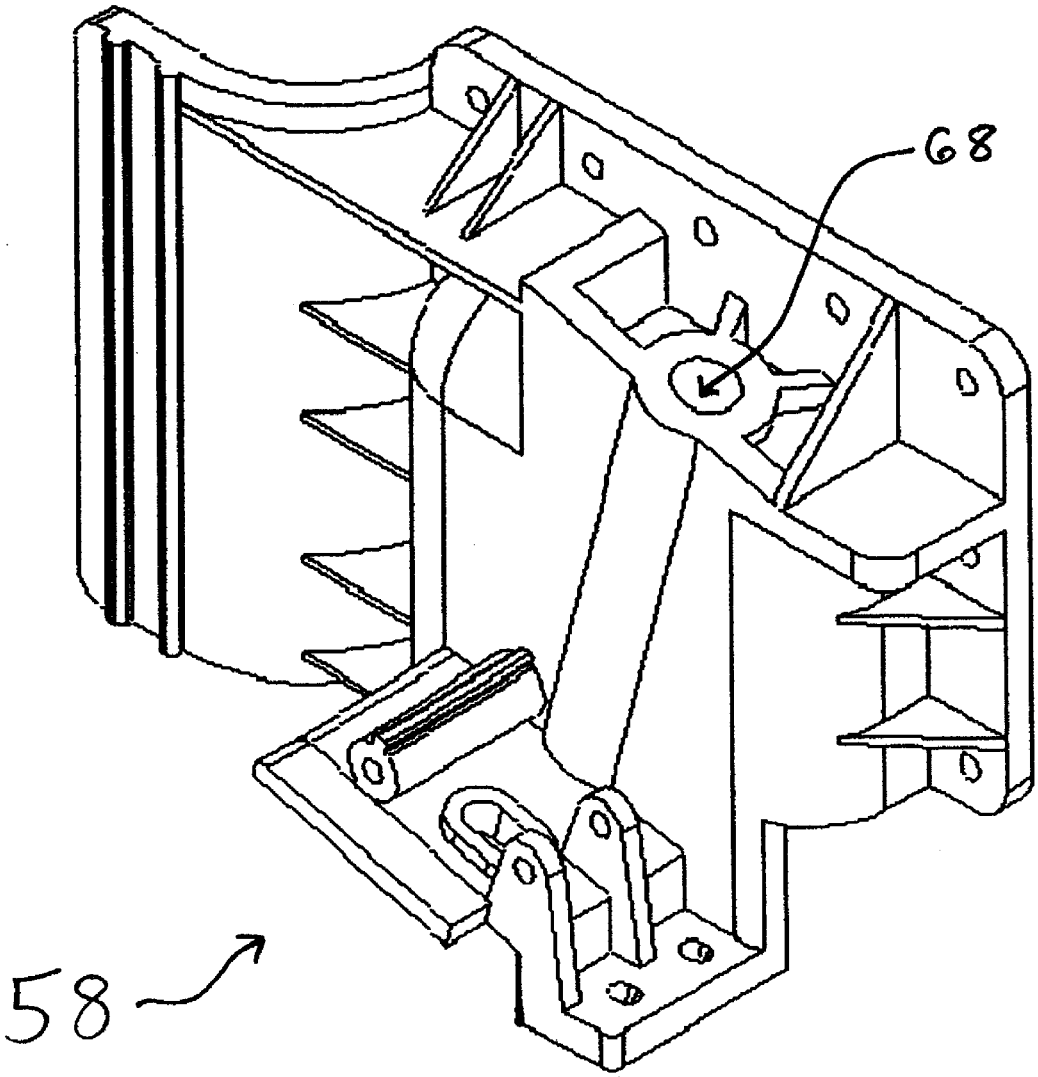
FIG. 9 is a perspective view of a brace unit of one embodiment used for securing a deployable foot to the chassis.

FIG. 9 is an enlarged, perspective view, of mounting base 58 connected to a corner of the chassis of the carrier. Mounting base 58 is secured to the chassis with a plurality of screws. In one embodiment, the chassis is formed from molded plastic, but other materials are contemplated depending on desired characteristics. When the stabilization foot is extended out, any load put on the desktop surface will create a moment force. The weight of a load placed on the desktop surface bears down on the arms and the stabilization arm causing a cantilever effect upon the chassis. Mounting base 58 is of a substantial expanse including multiple attachment points in order to more uniformly distribute the stress of this loading. In essence, mounting base 58 transfers the load of the cantilevered desktop surface throughout a sufficient region of the chassis to provide adequate support. In order to transfer the load from the mounting base to the chassis, multiple screw races may be needed.

An axle 68 around which the stabilization foot rotates can also be seen. In one embodiment, axle 68 is not parallel to the chassis and the support arms, but instead the top of axle 68 is tilted at an angle of a few degrees. Tilting axle 68 allows the stabilization foot to provide support by having one end in contact with the ground when extended away from the chassis while the other end that is attached to the mounting base is not touching the ground.

The previous description is of a preferred embodiment for implementing the invention, and the scope of the invention should not necessarily be limited by this description. The scope of the present invention is instead defined by the following claims.

What is claimed is:

1. A combined desk and article carrier assembly adapted for transporting at least one article in one mode and for serving as a work desk in another mode, the assembly comprising:

a chassis having upper and lower ends, the lower end having wheels and the upper end having first and second telescoping arms extending therefrom in generally parallel spaced relationship;

a handle connecting distal ends of the first telescoping arm and the second telescoping arm;

a cross member disposed between the handle and the chassis and having the first and second telescoping arms running therethrough in slidable engagement therewith;

an article support shelf connected to a first side of the chassis near the lower end thereof for supporting at least one article placed thereon;

a desk-top shelf pivotally connected to the cross member and adapted to pivot outwardly and upwardly to a position generally orthogonal to the first and second telescoping arms to form a work desk;

a deployable foot connected to a corner region of the lower end of the chassis and adapted to angularly extend outwardly therefrom for stabilizing the chassis; and a telescoping strut with a first end pivotally connected to an underside of the desk-top shelf for securing the desk-top shelf in the position generally orthogonal to the first and second telescoping arms and a second end of the telescoping strut slidably connected to the chassis via mounting brackets.

2. The assembly of claim 1 wherein the article support shelf is pivotally connected to the chassis and adapted to extend outwardly and downwardly therefrom.

3. The assembly of claim 1 wherein the desk-top shelf fits with at least a portion of the chassis when the cross member is disposed at a position along the first and second telescoping arms closest to the chassis.

4. The assembly of claim 1 wherein the cross member locks into place when the cross member is slid along the first and second telescoping arms to a predetermined height above the chassis.

5. The assembly of claim 1 wherein the cross member comprises a release button that must be depressed before the cross member can be slid up the first and second telescoping arms.

6. The assembly of claim 1 wherein the handle is adapted to be lowered to a level substantially flush with a top surface of the desk-top shelf.

7. The assembly of claim 2 wherein the article support shelf locks into place when pivoted to a position generally orthogonal to the chassis.

8. A combined desk and article carrier assembly adapted for transporting at least one article in one mode and for serving as a work desk with loading thereupon in another mode, the assembly comprising:

a chassis formed of plastic having upper and lower ends, the lower end having wheels and the upper end having first and second telescoping arms extending therefrom;

a handle connecting distal ends of the first telescoping arm and the second telescoping arm;

a desk-top surface coupled to the first and second telescoping arms for supporting a load placed thereon;

a telescoping strut with a first end pivotally connected to an underside of the desk-top surface for securing the desk-top surface in a position generally orthogonal to the chassis and a second end of the telescoping strut slidably connected to the chassis via mounting brackets;

a mounting structure secured across a surface area in a corner region near the lower end of the chassis and adapted to distribute loading forces thereacross;

a deployable support foot pivotally connected to the mounting structure and adapted to angularly deploy outwardly from the chassis for stabilization thereof; and an axle for connecting a first end of the deployable support foot to the mounting structure.

9. The assembly of claim 8 wherein the deployable support foot is adapted to run substantially parallel to a bottom edge of the second side of the chassis and be secured thereagainst when not angularly deployed.

10. The assembly of claim 8 wherein the deployable support foot pivots along a plane that is greater than or equal to ninety degrees from the chassis.

11. The assembly of claim 8 wherein a top end of the axle is a greater distance from the first and second telescoping arms than a bottom end of the axle for angling a second end of the deployable foot lower than the first end of the deployable foot.

12. The assembly of claim 8 wherein the mounting structure is metal.

13. The assembly of claim 8 wherein the mounting structure is secured across a large enough surface area to prevent damage to the chassis caused by the load placed on the desk-top surface.

14. The assembly of claim 8 wherein the deployable foot locks into place when fully deployed.

15. The assembly of claim 8 wherein the mounting structure transfers loading forces caused by the load placed on the desk-top surface to the deployable foot to prevent the chassis from tipping over.

16. A combined desk and article carrier assembly adapted for transporting at least one article in one mode and for serving as a work desk with loading thereupon in another mode, the assembly comprising:

a chassis formed of plastic having upper and lower ends, the lower end having wheels and the upper end having first and second telescoping arms extending therefrom;

a handle connecting distal ends of the first telescoping arm and the second telescoping arm;

a desk-top surface coupled to the first and second telescoping arms for supporting a load placed thereon;

a telescoping strut with a first end pivotally connected to an underside of the desk-top surface for securing the desk-top surface in a position generally orthogonal to the chassis and a second end of the telescoping strut slidably connected to the chassis via mounting brackets;

a mounting structure secured across a surface area in a corner region near the lower end of the chassis and adapted to distribute loading forces thereacross;

a deployable support foot pivotally connected to the mounting structure and adapted to angularly deploy outwardly from the chassis for stabilization thereof; and wherein the mounting structure transfers loading forces caused by the load placed on the desk-top surface to the deployable foot to prevent the chassis from tipping over.

* * * * *